United States Patent [19]

Johnson

[11] 3,985,517

[45] Oct. 12, 1976

[54] COAL PASSIVATION PROCESS

[75] Inventor: Clarence A. Johnson, Princeton, N.J.

[73] Assignee: Hydrocarbon Research, Inc., Morristown, N.J.

[22] Filed: Aug. 20, 1975

[21] Appl. No.: 606,258

[52] U.S. Cl. ..... 44/1 R; 44/1 G; 44/6; 34/10

[51] Int. Cl.[2] ..... C10L 9/00; F26B 3/08

[58] Field of Search ..... 44/1 R, 1 G, 6; 201/23, 201/31; 34/10

[56] References Cited

UNITED STATES PATENTS

| | | | |
|---|---|---|---|
| 1,594,994 | 8/1926 | Bone | 44/1 R |
| 2,183,924 | 12/1939 | Schoch | 44/1 G |
| 3,414,480 | 12/1968 | Stotler et al. | 201/31 X |
| 3,565,766 | 2/1971 | Eddinger et al. | 201/31 X |

*Primary Examiner*—Carl F. Dees

[57] ABSTRACT

Low rank coals such as subbituminous or lignites containing more than about 10 weight percent moisture are dried and passivated against reabsorption of moisture in a fluidized bed by heating the particulate coal with a warm inert gas passing upwardly through the bed and simultaneously coating the warm particulate coal with a heavy liquid hydrocarbon material. Such coating aids in the removal of the moisture and prevents the reabsorption of moisture by the coal and thereby prevents consequential heating and possibly spontaneous ignition of the coal during its subsequent transportation or storage.

11 Claims, 2 Drawing Figures

COAL PASSIVATION PROCESS

BACKGROUND OF THE INVENTION

One of the major problems associated with using low rank coals such as those found in several of the western states of the United States is their high moisture content, usually ranging from about 15 to 50 weight percent. When such coal is shipped to the consumer, the high moisture content involves a large weight penalty and increased shipping expense. Also, upon firing such coal, considerable heat is required to vaporize this high moisture content, which reduces process efficiency. However, if the coal is dried to a very low moisture content before shipment, it experiences significant reabsorption of moisture and consequential heating as soon as subject to the air. This makes the coal subject to spontaneous ignition during shipment and/or subsequent storage and has resulted in serious fires.

The desirability of drying such high moisture coals and passivating them so as to substantially prevent the reabsorption of moisture has been recognized. For example, U.S. Pat. No. 1,905,513 to Stuart describes a method for filming (coating) coal with a preserving hydrocarbon film which is impervious to both air and water so as to help prevent dusting and oxidation of the coal before burning. U.S. Pat. No. 1,960,917 to Nagelvoort describes a method for removing excess moisture from wetted coal by spraying it with a dilute oil emulsion to facilitate the drainage of excess water from the coal. Also, U.S. Pat. No. 2,197,792 to Erickson describes apparatus for spraying of coal with oil or wax to prevent dusting, while Wattles — U.S. Pat. No. 2,204,781 — describes coating exposed surfaces of coal piles with a protective weather-excluding coating material. Furthermore, Lykken in U.S. Pat. No. 2,610,115 and U.S. Pat. No. 2,811,427 describes a method for dehydrating lignite by mixing it with 3–10 weight percent mineral hydrocarbon at normal temperature and then heating the mixture to about 300° F in a rotating kiln to remove moisture and leave the lignite particles coated with the hydrocarbon material.

While the problem of spontaneous combustion of low rank coals is well recognized and over a period of more than fifty years many capable scientists have offered solutions, usually based on small laboratory tests, there is still no practical process for accomplishing passivation on both a large scale and at an economically low cost.

SUMMARY OF THE INVENTION

We have discovered that high moisture-containing low rank coals such as subbituminous coal or lignites, containing at least about 10 weight percent moisture and usually 15–50 weight percent, can be dried and passivated effectively against reabsorption of appreciable moisture by processing in a fluidized bed treating zone. The low rank coal in suitable particulate form is fed into the bed and a stream of hot inert gas is passed upwardly through the bed at sufficient velocity to fluidize the particles. The low rank coal is thereby heated to at least about 200° F to initiate evaporation of its moisture to less than about 5.0 weight percent, but is not heated to such a temperature as to cause devolatilization. A heavy hydrocarbon liquid material, which can be introduced by itself or preferably diluted with a light hydrocarbon solvent carrier liquid, is sprayed into the heated and fluidized bed and preferably into the lower portion of the bed. The carbonaceous particulate material is coated with at least about 0.5 weight percent of the heavy hydrocarbon material, which effectively seals the pores of the particles so as to substantially limit their subsequent reabsorption of moisture. The resulting dried and passivated low rank coal is then withdrawn from the lower portion of the fluidized bed.

The warm moisture-containing vapors evolved from the low rank coal along with any volatilized light solvent liquid is withdrawn from above the upper end of the fluidized bed treating zone and the water and solvent portion is substantially removed by a cooling and condensation step, followed by a phase separation step from which condensate is removed and may be recovered for reuse. The resulting gas, comprising largely hydrocarbon vapors, is then reheated and is recirculated to the lower end of the fluidized bed to heat and fluidize same. If desired to achieve greater moisture removal from the low rank coal, the fluidized bed can be heated to higher temperatures, such as above about 250° F, but below about 500° F.

A condensed light oil residue stream can also be withdrawn from the gas-liquid separation step. At least a portion of this light oil can be preferably reintroduced into the fluidized bed as the light solvent carrier liquid by mixing it with the heavy hydrocarbon liquid before injecting it into the fluidized bed.

The recycled inert fluidizing gas should have a low oxygen content not exceeding about two volume percent, so as to prevent combustion of the heated carbonaceous particulate material in the fluidized bed. Thus, atmospheric air is not suitable as the fluidizing gas. Furthermore, by utilizing a relatively inert fluidizing gas and recycling it back to the treating zone after heating, the gas temperature is always maintained somewhat above ambient temperature. It is noted that less heat is required to be added to the fluidizing gas by such recirculation than if fresh inert gas at ambient temperature were used.

The advantages of this invention are not only that the high moisture-containing low rank coals such as subbituminous coals and lignites are conveniently converted into a low moisture-containing solid particulate fuel that is not subject to autoignition during subsequent shipping and storage, but also that the coated material has increased inherent particle strength. Thus, its tendency to crumbling during handling and shipment is significantly reduced. There is also some increase in gross heating value even though the oil added is relatively small.

DESCRIPTION OF PREFERRED EMBODIMENT

Figure 1:
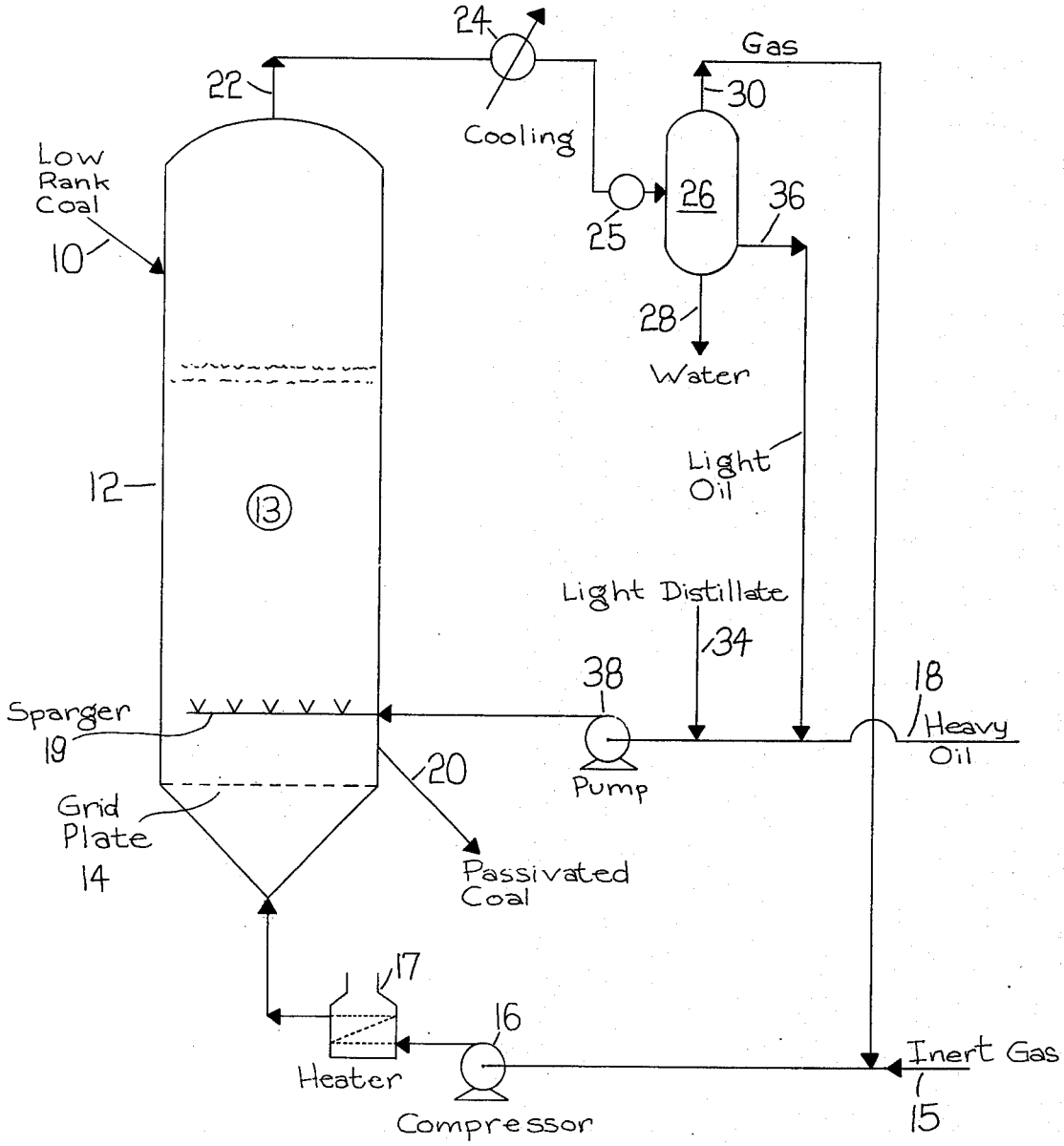
FIG. 1 is a schematic view of a fluidized bed process for the drying and passivation of low rank subbituminous coals and lignites.

As shown in FIG. 1, raw low rank subbituminous coal or lignite at 10 containing at least 10 weight percent moisture and usually 15–50 weight percent moisture and which has been crushed to be finer than about ½-inch particle size is introduced into vessel 12 to provide bed 13 supported by perforated grid plate 14. An inert gas at 15 such as $N_2$, $CO_2$ or a mixture thereof is compressed at 16, heated by a suitable source at 17 and introduced into the lower end of vessel 12 at sufficient flow rate to fluidize the bed of coal particles. The gas is heated sufficiently to heat the coal particles to a temperature preferably in the range of 250° to 500° F. A heavy liquid hydrocarbon material at 18 is also injected into the fluidized bed through sparger means 19. The pressure within the vessel 12 is essentially atmospheric, but could have a slight positive pressure if desired. Fluidized bed zone pressures above 10 psig are unnecessary.

During heating and fluidization of the bed of coal, the moisture in the coal particles is driven off into the fluidizing gas and the particulate coal is uniformly coated with the heavy hydrocarbon liquid. The coated and passivated coal is continuously withdrawn from the vessel at outlet 20. The warm moisture-containing gas evaporated from the coal is withdrawn from the upper end of vessel 12 as stream 22 and is cooled at 24, usually against air or a cooling water stream. The cooled gas is pressure-reduced at 25 and passed to phase separator 26. The condensed water portion is drained away as stream 28, and the light inert gas portion is withdrawn overhead as stream 30. This gas stream 30 comprising water and hydrocarbon vapors is repressurized at compressor 16 and recirculated through heat source 17 back to vessel 12 for reuse therein as the fluidizing gas. Make-up inert gas can be added at 15 as needed to provide adequate gas for heating and fluidizing the bed 13.

If desired, a light distillate oil at 34 can be mixed with the heavy liquid hydrocarbon stream 18 as a carrier oil to adjust the composition and viscosity of this heavy liquid stream so as to assist in the uniform coating of the coal particles in the fluidized bed. In this event, a light condensed oil stream 36 can also be removed from separator 26, and can preferably comprise a major portion of solvent carrier oil stream 34 which is recirculated by pump 38. Although sufficent heavy hydrocarbon liquid should be introduced at 18 to coat the particulate material with at least about 0.5 weight percent oil, improved passivation results may be obtained by preferably adding between 1.5–5.0 weight percent oil to the coal.

Figure 2:
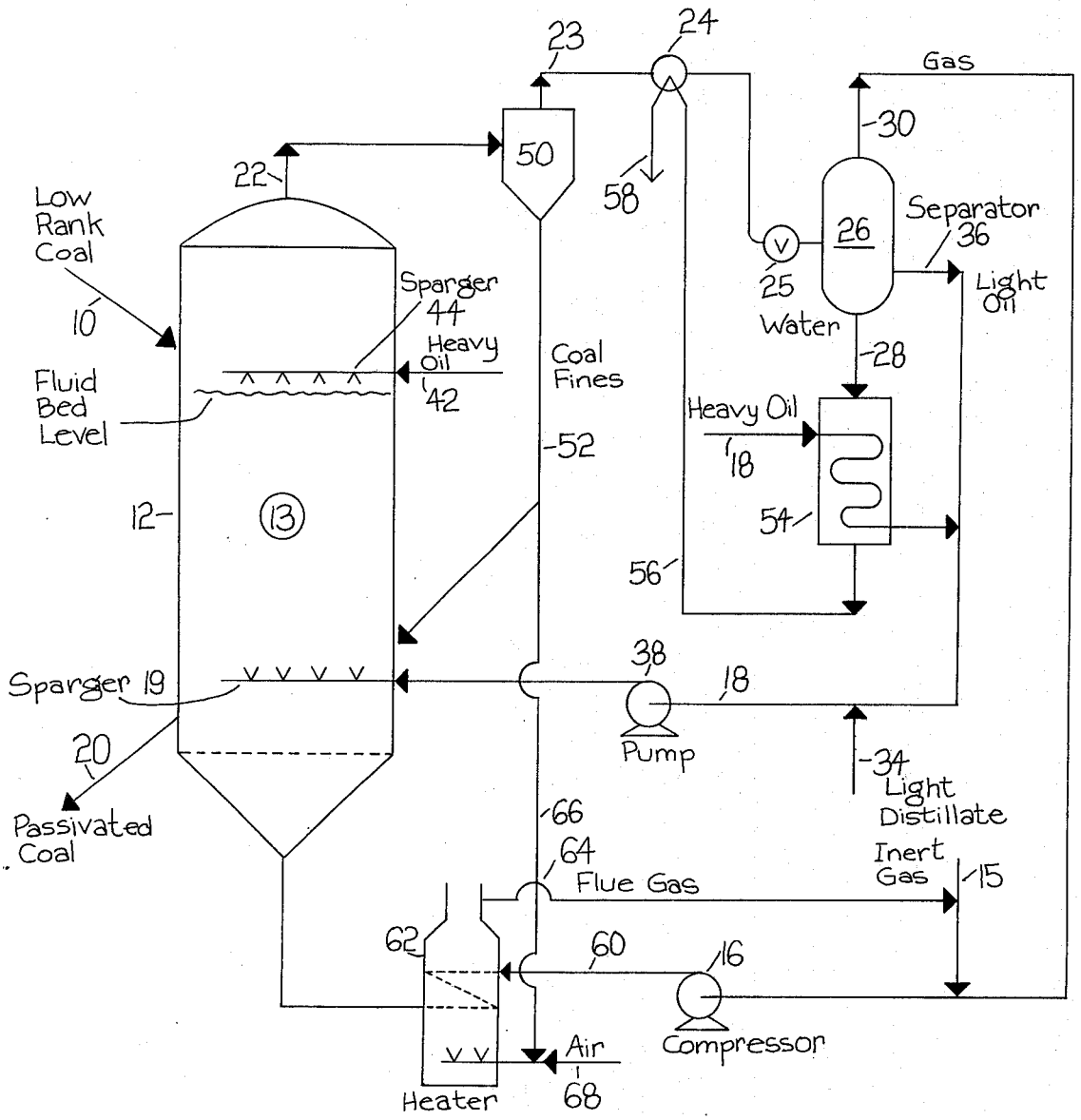
FIG. 2 is a schematic drawing of a modified process for drying and passivation of subbituminous coals and lignites.

FIG. 2 shows an alternative embodiment of the invention, with the same item numbers being used for that apparatus which is functionally similar to the apparatus in FIG. 1. The particulate low rank coal at 10 is introduced into treating vessel 12 as before and if desired some additional heavy oil at 42 can be sprayed onto the coal through sparger means 44 located in the upper portion of the fluidized bed 13. Furthermore, coal fines from the bed which may be entrained in the effluent gas stream 22 are removed in gas-solids separator device 50, and are returned to the lower portion of the fluidized bed through conduit 52. The cleaned gas is removed as stream 23 and passed to cooler 24 where it is cooled against a convenient fluid, e.g., atmospheric air or water. The cooled gas can then be pressure-reduced at 25 and passed to phase separator 26 from which the water portion is drained away as stream 28.

The heat contained in this water stream 28, which may be at 100°–200° F temperature, depending upon the cooling fluid used, can be partially recovered by utilizing it to preheat the heavy hydrocarbon liquid stream 18 in heat exchanger 54. The resulting cooled water stream 56 can then be used as a portion of the cooling fluid in heat exchanger 24, after which it is discarded at 58.

The light gas or vapor stream 30 is withdrawn from phase separator 26, repressured at compressor 16, and recirculated through an appropriate heat source 62 back to vessel 12 for reuse therein. Makeup inert fluidizing gas can be added at 15 as needed to provide adequate gas for heating and fluidizing bed 13.

Similarly as for FIG. 1, a light distillate oil 34 can be mized with the heavy hydrocarbon stream 18 as a carrier oil to adjust the composition and viscosity of the stream so as to assist in the uniform coating of the coal particles in the fluidized bed. If a carrier oil is used, a light condensed oil can be recovered at 36 and pressurized at 38 and mixed with the heavy oil at 18 for coating the coal.

In this FIG. 2 embodiment, the compressed fluidizing gas at 60 is preferably heated in a coal-fired heater 62. A portion 64 of the resulting flue gas stream is withdrawn from heater 62 and utilized as makeup inert gas stream 15. Also, heater 62 is preferably fired using a portion 66 of the dried coal fines 52 removed from gas-solids separator 50 together with the necessary combustion air at 68.

A preferred operation for western United States coals having as much as 50 weight percent moisture is to reduce the coal to a size between ⅛- and ⅜-inch, pass an inert gas through the fluidized bed at a temperature between 250° and 500° F, at a pressure between 0.5 and 5.0 psig, and simultaneously spray the bed with a heavy hydrocarbon residual oil having a boiling range above 650° F, diluted with a lighter carrier oil recovered from the effluent vapors and recovering a dry and passivated coal having less than 2.0 weight percent oil coating, and residual moisture of less than 5.0 percent.

While we have shown preferred forms of embodiment of our invention, we are aware that modifications may be made thereto within the spirit and scope of the disclosure and as defined by the appended claims.

We claim:

1. A process for passivating particulate pyrophoric low rank coals, in a fluidized treating vessel, wherein the material is simultaneously dried and coated with a hydrocarbon liquid, thereby rendering the material substantially resistant to reabsorption of moisture and adaptable for storage and shipment at ambient temperatures, comprising the steps of:

a. feeding the material to the treating vessel;
b. drying the material with a hot inert gas, maintained at a temperature sufficient to vaporize the moisture without devolatilizing the particulate material, said inert gas being introduced below the material in the treating zone and maintained at sufficient velocity to form a fluidized bed;
c. introducing a heavy liquid hydrocarbon into the treating vessel;
d. substantially uniformly coating the material with between about 0.5 to 2.5 weight percent of a heavy hydrocarbon liquid;
e. removing an effluent gas stream consisting essentially of water and hydrocarbons from the vessel;
f. withdrawing the hydrocarbon coated particulate material from the treating vessel.

2. The process of claim 1 wherein the fluidized bed temperature is maintained between 200° and 500° F and the pressure is maintained between 0 psig and 10 psig.

3. The process of claim 1 wherein a light condensed oil stream is withdrawn from the phase separation step (e) and at least a portion of the condensed oil is mixed with the heavy liquid hydrocarbon material as a carrier oil before being introduced into the fluidized bed.

4. The process of claim 1 wherein the gas stream withdrawn from the upper end of the treating zone is passed through a solids separation step before the cooling step, and the particulate fines removed therefrom are returned to the fluidized bed.

5. The process of claim 1 wherein the inert recycled gas is heated by a combustion type heater fired by a portion of the solid carbonaceous material and a portion of the flue gas produced therefrom is used as make-up for the inert fluidizing and heating gas.

6. The process of claim 1 wherein sufficient hydrocarbon liquid is introduced into the treating zone to coat the particulate solid material with 1.0 to 5.0 weight percent oil.

7. The process of claim 1 wherein a portion of the heavy liquid hydrocarbon material is introduced into the reaction zone in the upper portion of the fluidized bed.

8. The process of claim 1 wherein the pyrophoric particulate material is crushed to smaller than about ½-inch particle size.

9. The process of claim 1 wherein the water stream removed at step (c) is used to preheat the heavy liquid hydrocarbon material introduced into the fluidized bed.

10. The process of claim 9 wherein the cooled water from the liquid hydrocarbon preheating step is further used to partially cool the reactor effluent gas upstream of the phase separation step.

11. The process of claim 1 wherein the pyrophoric carbonaceous material is sized to between ⅛-inch and ⅜-inch, the pressure of the inert gas is 0.5 to 5.0 psig, the drying period is from 3 to 15 minutes, the temperature is between 200° and 500° F, the heavy hydrocarbon is a residual hydrocarbon having a boiling range above 650° F which is sprayed on the carbonaceous material and the passivated material is recovered with from 1.0 to 2.0 weight percent of oil coating and a residual moisture of less than 5.0 weight percent.

* * * * *